United States Patent [19]

Röttel

[11] Patent Number: 5,017,105

[45] Date of Patent: May 21, 1991

[54] METERING PUMP

[75] Inventor: Franz Röttel, Höchstädt, Fed. Rep. of Germany

[73] Assignee: Grunbeck Waseraufbereitung GmbH, Hochstadt, Fed. Rep. of Germany

[21] Appl. No.: 570,147

[22] Filed: Aug. 20, 1990

[30] Foreign Application Priority Data

Aug. 23, 1990 [DE] Fed. Rep. of Germany ..... 3928411

[51] Int. Cl.[5] ..... F04B 39/00

[52] U.S. Cl. ..... 417/439; 417/503; 417/521

[58] Field of Search ..... 417/439, 569, 570, 503, 417/521, 486

[56] References Cited

U.S. PATENT DOCUMENTS

| | | | |
|---|---|---|---|
| 3,887,305 | 6/1975 | Ito | 417/439 |
| 4,256,440 | 3/1981 | Kern et al. | 417/503 |
| 4,515,537 | 5/1985 | Arens | 417/503 |
| 4,523,903 | 6/1985 | Arens | 417/503 |

FOREIGN PATENT DOCUMENTS

| | | |
|---|---|---|
| 7733135 | 3/1978 | Fed. Rep. of Germany . |
| 3134940C2 | 12/1983 | Fed. Rep. of Germany . |
| 3210821C2 | 1/1986 | Fed. Rep. of Germany . |
| 3738656C1 | 3/1989 | Fed. Rep. of Germany . |

*Primary Examiner*—Leonard E. Smith
*Assistant Examiner*—Charles G. Freay, Jr.
*Attorney, Agent, or Firm*—Donald Brown

[57] ABSTRACT

A metering pump comprises a diaphragm chamber with a diaphragm, a suction conduit connecting the diaphragm chamber with a metering agent tank, a pump cylinder defining a cylinder space and having an inlet connected to the diaphragm chamber and an outlet connected to a metering point through a metering conduit, and a metering piston in the pump cylinder. The metering piston is formed as a hollow tubular piston which comprises an annular seal disk at the side thereof opposite to the metering conduit. The cylinder space is defined by a stop ring and an actuating tappet movingly passes therethrough. At the beginning of a suction stroke the seal disk sealingly abuts the stop ring but allows the metering agent to pass through during the further movement of the tappet. The metering piston in no position thereof emerges from a compression ring.

7 Claims, 2 Drawing Sheets

METERING PUMP

BACKGROUND OF THE INVENTION

The invention relates to a metering pump having a predelivery chamber or diaphragm chamber, a pump cylinder and a metering piston co-operating with the pump cylinder. The predelivery chamber may be positioned above or laterally of the pump cylinder.

In conventional metering pumps having a metering piston-cylinder means and a predelivery diaphragm the predelivery chamber is connected with a metering agent tank through a suction conduit with a suction valve and a return conduit with a pressure valve. The metering agent is predelivered through the suction conduit and the suction valve into the predelivery chamber. The metering piston withdraws the required amount of metering agent from the predelivery chamber. The excess amount of metering agent is returned into the metering agent tank through a return conduit and a pressure valve. The metering piston emerges from the compression ring in the cylinder space for ventilation of the compression space. The repeated engagement or immersion of the metering piston into the compression ring causes a rapid mechanical wear of the latter which leads to high replacement expenses for such a cheap part as the compression ring.

OBJECTS OF THE INVENTION

It is an object of the invention to provide an improved metering pump in which the above-mentioned draw back is avoided. It is a further object to provide a metering pump for metering liquid media and in particular aggressive and/easily vapourizing media. It is a further object of the invention to avoid the emersion of the metering piston from the compression ring. It is a still further object of the invention to provide a metering pump which is self-aspirating and self-venting even when metering against a pressure head and which can be mounted in vertical or horizontal position.

SUMMARY OF THE INVENTION

In order to achieve the above-mentioned objects the invention provides a metering pump comprising a diaphragm chamber with a diaphragm, a suction conduit connecting said diaphragm chamber with a metering agent tank, a pump cylinder defining a compression space and a cylinder space and having an inlet connected to said diaphragm chamber and an outlet connected to a metering point through a metering conduit, a hollow metering piston being provided in said pump cylinder and having a through-bore and an annular seal disk at the side thereof opposite to said metering conduit, a tappet for actuating said piston, means for pressing said seal disk against one end of said tappet, the tappet side of said cylinder space being defined by a stop ring of a size such that the tappet is free to pass therethrough while leaving an annular gap, a piston guide provided in an outlet side of said cylinder space for guiding said piston during the entire suction and pressure stroke thereof, whereby the distance between said compression space and said seal disk, the position of said stop ring in said cylinder space and the stroke of said tappet are selected to provide a sealing abutment of said seal disk against said stop ring in a second phase of the suction stroke and to allow a flow of the metering agent from said diaphragm chamber to said compression chamber through said through-bore of said hollow piston at the end of said suction stroke and in a first phase of the metering stroke.

BRIEF DESCRIPTION OF THE DRAWINGS

Further advantages, features and objects of the invention will stand out from the following description of exemplary embodiments with reference to the drawings, wherein.

DESCRIPTION OF PREFERRED EMBODIMENTS

Figure 1:
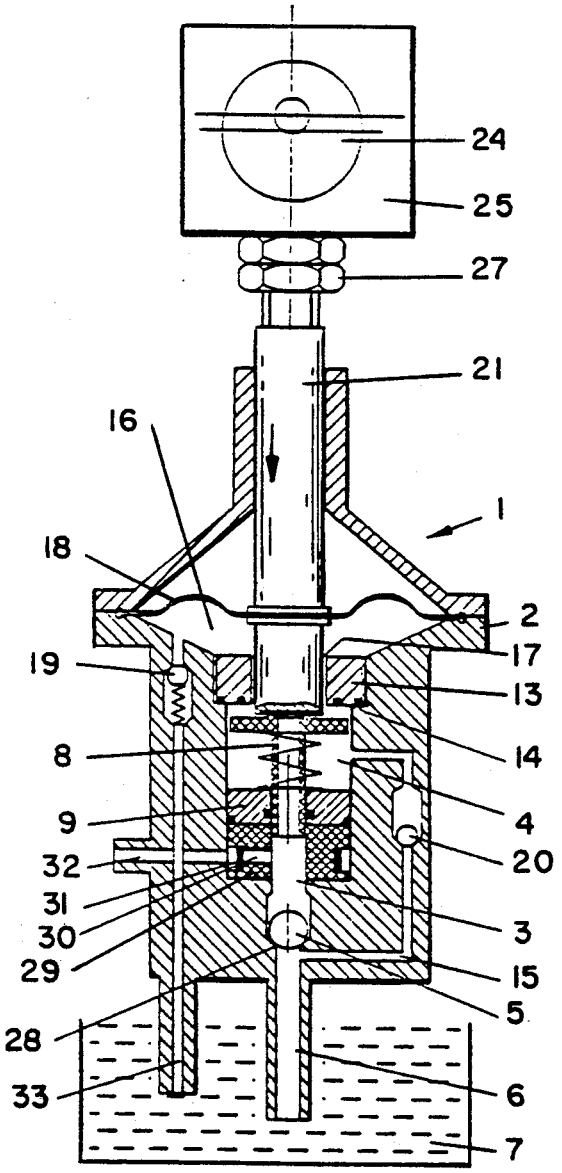
FIGS. 1 to 3 show a first embodiment of the invention with the metering stroke and the suction stroke being represented in FIGS. 1 and 2 and a particular position of the pump during the suction stroke being shown on an enlarged scale in FIG. 3.

FIG. 1 shows a metering pump 1 with housing 2 including a compression space 3 and a cylinder space 4 there above. The compression space 3 has an inlet connected with a metering agent tank 7 through a suction conduit 6 and a suction valve 5. A metering piston 8 is formed as a hollow tubular piston which is guided in a piston guide 9. A compression ring 10 is provided in the piston guide 9. The upper side of the hollow piston is formed as a seal disk 11 which may include a seal bead or projection at the upper side thereof. The upper side of the cylinder space 4 is defined by a stop ring 13. A lifting or actuating tappet 21 may freely pass or move through the stop ring 13, whereby an annular gap or clearance 17 exists between the tappet 21 and the inner periphery of the stop ring 13. Metering agent from the cylinder space 4 may enter into a diaphragm space 16 through the gap 17.

The diaphragm space 16 is upwardly defined by a predelivery diaphragm 18 and is in fluid connection with the cylinder space 4 unless the seal disk 11 abuts the stop ring 13. Any excess predelivered agent is returned to the metering agent tank 7 through a return conduit 33 and a return valve 19.

Metering agent is sucked from the metering agent tank 7 through the suction conduit 6, a by-pass conduit 15 and a check valve 20 into the cylinder space 4 and further through the gap 17 between the inner periphery of the stop ring 13 and the outer periphery of the tappet 21 into the diaphragm chamber 16 by means of the sucking action of the predelivery diaphragm 18.

The return valve 19 is closed during the suction phase. At the beginning of the suction stroke the hollow piston 8 with the seal disk 11 is pressed against a gasket 22 at the tappet 21 by means of a spring 24 until the seal disk 11 comes into abutment with the stop ring 13 in the further movement of the tappet 21.

Figure 2:
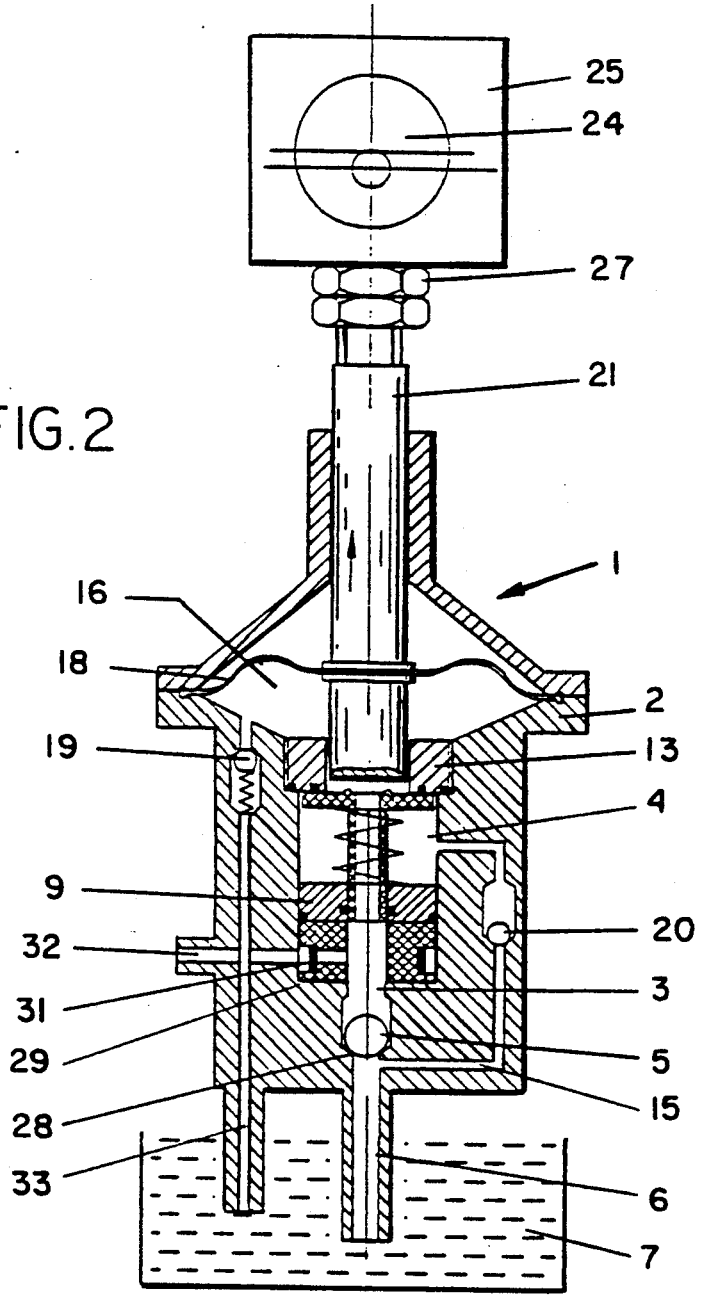
Figure 3:
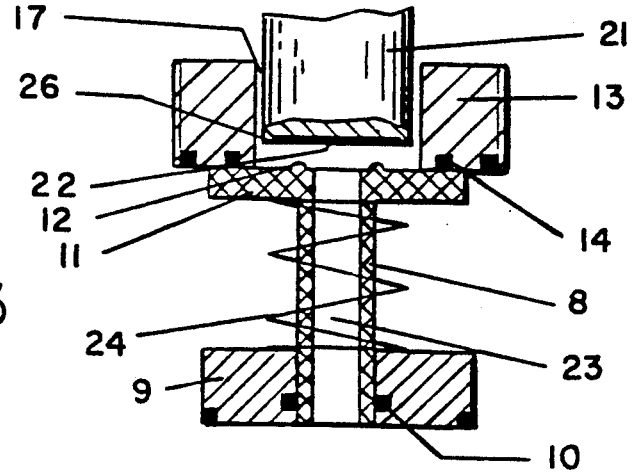

When during the suction stroke the hollow piston 8 reaches the stop ring 13, as shown in FIGS. 2 and 3, the seal disk 11 of the hollow piston closes the gap 17 by a seal ring 14 and thereby prevents further suction of metering agent through the gap 17. Hence, no further suction of metering agent through the by-pass conduit 15 and the check valve 20 is possible. In a further phase of the suction stroke of the tappet 21 the through-bore 23 of the hollow piston 8 is opened. Metering agent is now sucked directly through the suction valve 5 and the compression space 3 as well as through the through-bore 23 of the hollow piston. The compression space 3 is filled with metering agent and at the same time completely ventilated or bleeded without the hollow piston 8 having to emerge from the piston guide 9 or the compression ring 10, respectively.

After finishing the suction stroke an eccentric or cam 24' and a yoke 25 actuate the tappet 21 to move into the opposite direction for effecting a metering stroke (c.f. FIG. 1) until the tappet 21 sealingly rests on the seal bead 12 of the seal disk 11 and thereby bead 12 of the seal disk 11 and thereby closes the through-bore 23 of the hollow piston 8. In the further metering stroke the peripheral edge 26 of the tappet 21 effects the force transmission to the hollow piston 8 and the spring 24. This allows to obtain a constant compression stiffness during the metering stroke. After having contacted the seal disk 11 the tappet 21 further presses the hollow piston 8 against the force of the spring up to a lower maximum value adjusted at a stroke control mechanism 27.

During the metering stroke of the tappet 21 and the hollow piston 8 the suction valve 5 is pressed against a seal or valve seat 28 and closes the suction conduit 6. Thereby the metering agent in the compression space 3 is forced into the metering conduit 32 through a cross-bore 30 provided in the cylinder 29 and a tube valve 31.

Metering agent which has been excessively aspirated by the predelivery diaphragm 18 and eventually existing gas bubbles are returned into the metering agent tanks 7 during the metering stroke through the return valve 19 and the return conduit 33. Gas bubbles which have been returned into the metering agent tank 7 rise to the atmosphere when leaving the return conduit and are not re-aspirated. After finishing the metering stroke the eccentric or cam 24' initiates a new suction stroke.

Figure 4:
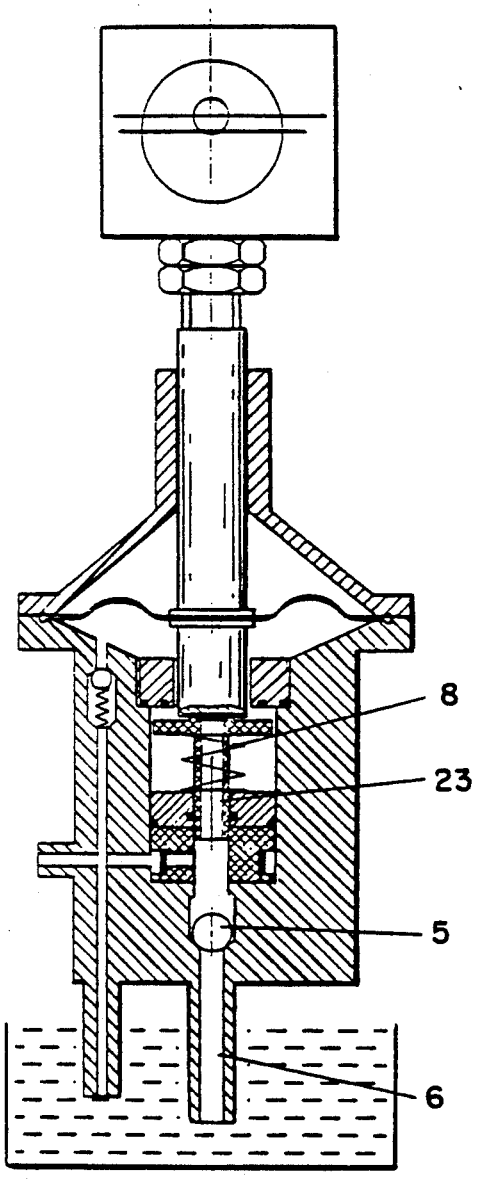
FIG. 4 shows a further embodiment of the invention.

In the embodiment shown in FIG. 4 the metering agent is aspirated directly through the suction conduit 6, the suction valve 5 and the through-bore 23 in the hollow piston 8. In a further phase of the suction stroke the tappet 21 is lifted from the sealing lid or bead 12 of the disk 11. The metering agent is then delivered through the hollow piston 8 and the gap 17 into the diaphragm chamber space 16 by means of the predelivery diaphragm 18. The compression space is completely filled with metering agent and ventilated or bleeded. In this embodiment the by-pass conduit 15 and the check valve 20 are not required. This embodiment is particularly suitable for small metering strokes. The further parts correspond to those of the embodiment shown in FIGS. 1 and 2.

Although the invention has been described with reference to specific example embodiments, it is to be understood that it is intended to cover all modifications and equivalents within the scope of the appended claims.

What is claimed is:

1. A metering pump comprising a diaphragm chamber with a diaphragm, a suction conduit connecting said diaphragm chamber with a metering agent tank, a pump cylinder defining a compression space and a cylinder,.space and having an inlet connected to said diaphragm chamber and an outlet connected to the metering point through a metering conduit, a hollow metering piston being provided in said pump cylinder and having a through-bore and an annular seal disk at the side thereof opposite to said metering conduit, a tappet for actuating said piston, means for pressing said seal disk against one end of said tappet, the tappet side of said cylinder space being defined by a stop ring of a size such that said tappet is free to pass therethrough while leaving an annular gap, a piston guide provided in an outlet side of said cylinder space for guiding said piston during entire suction and pressure stroke thereof, whereby the distance between said compression space and said seal disk, the position of said stop ring in said cylinder space and the stroke of said tappet are selected to provide a sealing abutment of said seal disk against said stop ring in a second phase of the suction stroke and to allow a flow of the metering agent from said diaphragm chamber into said compression chamber through said through-bore of said hollow piston at the end of the suction stroke and in a first phase of the metering stroke.

2. The metering pump of claim 1, comprising a by-pass conduit including a suction valve and connecting said cylinder space with said metering agent tank.

3. The metering pump of claim 1, comprising a compression ring provided in said piston guide.

4. The metering pump of claim 1, comprising a seal bead provided at the side of said seal disk which abuts said tappet.

5. The metering pump of claim 1, wherein said stop ring comprises at least one seal ring at the side thereof which abuts said seal disk.

6. The metering pump of claim 1, wherein said tappet has a peripheral edge at the side thereof which abuts said seal disk.

7. The metering pump of claim 1, comprising a spring which provides an non-positive pressing connection between said seal disk and said tappet and which is supported at said piston guide and said seal disk.

* * * * *